United States Patent [19]

Hedgewick

[11] 4,444,327

[45] Apr. 24, 1984

[54] TIGHT VIAL ASSEMBLY WITH ONE-PIECE CAP

[76] Inventor: Peter Hedgewick, 3691 Victoria Blvd., Windsor, Ontario, Canada

[21] Appl. No.: 474,437

[22] Filed: Mar. 11, 1983

[51] Int. Cl.[3] ..... B65D 55/02

[52] U.S. Cl. ..... 215/211; 215/222

[58] Field of Search ..... 215/211, 222, 320, 355

[56] References Cited

U.S. PATENT DOCUMENTS

| | | | |
|---|---|---|---|
| 3,608,764 | 9/1971 | Hedgewick | 215/222 |
| 3,756,445 | 9/1973 | Hedgewick | 215/222 |
| 4,049,148 | 9/1977 | Suhr et al. | 215/222 |
| 4,397,397 | 8/1983 | Herr | 215/211 |
| 4,399,920 | 8/1983 | Swartzbaugh et al. | 215/211 |

*Primary Examiner*—George T. Hall

*Attorney, Agent, or Firm*—Reising, Ethington, Barnard, Perry & Milton

[57] ABSTRACT

A safety container and closure assembly including an integrally-molded, one-piece plastic cap having a sealing portion which provides an "oil-can" effect during axial and rotative motion of the cap relative to the container. The sealing portion comprises a relatively thin, radially outwardly curved wall which is integrally joined to a relatively stiff annular base portion from which a peripheral skirt portion axially projects for receiving the mouth of the container. Integrally formed with the sealing portion is a relatively thin, annular biasing portion which, in turn, is integrally formed with a relatively stiff, inner, disc-like base portion. The biasing portion biases the sealing portion to axially spaced positions such that when the cap is placed on the container, the biasing portion biases the cap in a fixed axial sealing position relative to the container and simultaneously applies pressure to the sealing portion. Preferably, a rib comprising an O-ring seal projects inwardly on the inner surface of the mouth portion of a container and simultaneously engages the sealing portion during the axial and rotative motion of the cap relative to the container.

12 Claims, 4 Drawing Figures

TIGHT VIAL ASSEMBLY WITH ONE-PIECE CAP

TECHNICAL FIELD

This invention relates generally to safety closure and container assemblies and, in particular, is concerned with improvements of safety closure and container assemblies wherein it is necessary to provide a liquid or moisture-proof seal for the contents of the container.

BACKGROUND ART

In order to reduce the number of accidental poisonings resulting from young children having access to unsafe medicines, drugs, household chemicals and other products, there has been considerable activity toward the development of closures and containers in which a type of manipulation between the cap and container is required to gain access to the contents of the container that a young child is incapable of performing. For example, it has been found that young children are generally incapable of manipulating a cap mounted on a container with a bayonet-type locking mechanism—a type of locking mechanism that requires that the cap be pushed relative to the container and then rotated relative to the container in order to separate the cap from the container. The cap must be pushed axially toward the container against the biasing force of a spring in order to disengage the bayonet locking mechanism. For example, see Hedgewick U.S. Pat. No. Re. 27,156. Other examples of safety closure and container assemblies having various locking and sealing arrangements are disclosed in U.S. Pat. Nos. 3,608,764 and 3,478,911.

When the contents of a container is a liquid or is some substance which deteriorates in an atmosphere of high humidity, the closure must be capable of maintaining an adequate seal under a variety of conditions. The contents of the container of liquid may require vigorous shaking before being used or the contents may be of the type that causes a pressure build-up within the container over a period of time. A tight seal is also necessary in order to prevent the undesired escape of the contents from the container and because the entrance of moisture and other contaminants into the container may cause deterioration of the contents.

In order to maintain a good seal against the entrance or escape of moisture, it is desirable to be able to provide a seal that projects into the mouth of the container and engages the inner surface of the container mouth with a tight fit. While the spring force on the cap should be sufficient to prevent children from gaining access to the contents, it should not be so great as to make it unduly difficult for adults to manipulate the cap. Accordingly, a tight seal must be maintained by the closure without, at the same time, making it too difficult for adults, particularly arthritic adults, to manipulate the closure.

As previously mentioned, in order to provide a tight moisture-proof seal, it is generally necessary for the cap to carry a sealing member with a flange that projects into the mouth of the container into tight sealing engagement with the inner surface thereof. U.S. Pat. Nos. 3,613,928, 3,623,623, 4,049,148, 3,435,975, 3,482,725, 4,090,629, 3,917,096 and Canadian Pat. No. 759,306 all disclose safety closure and container assemblies having sealing members that are pushed into the mouth of the container. Considerable force is typically required in order to insert and remove such sealing members from the mouth of the container. With conventional bayonet locking elements on the cap and container of the type shown in the patents referred to in the preceding paragraph, a seal is inserted into and removed from the container primarily by the application of direct axial force between the cap and the container. The operator in applying the cap to the container must first exert considerable axial pressure between the cap and the container in order to force the seal into the mouth of the container before the cap is rotated into locked engagement with the container. Conversely, in order to remove the cap from the container, after the cap has been unlocked from the container, the operator must pull the cap and seal axially from the container with a force sufficient to overcome the resistance of the seal to disengage from the container. For aged, arthritic or otherwise infirm users, the force required can cause considerable inconvenience.

DISCLOSURE OF THE INVENTION

An object of this invention is to provide a safety closure and container assembly wherein a moisture-proof seal is provided by a sealing portion of an integrally molded cap which projects into the container mouth and wherein a cap and container locking mechanism which permits the cap to be applied to the container upon the application of a combined axial and rotative motion of the cap relative to the container, forces the sealing portion into tight engagement with the mouth of the container such that the sealing portion provides an "oil-can" effect.

A further object is to provide a tight, moisture-proof safety closure and container assembly having an improved sealing mechanism provided by a sealing portion which provides an "oil-can" effect, a biasing portion of the cap and a rib which projects inwardly on the inner surface of a mouth portion of the container adjacent a rim of the mouth portion and which comprises an O-ring seal.

In carrying out the foregoing and other objects, a child-resistant closure assembly according to the present invention includes a container having a mouth portion with an annular radius rim termed as an "O" ring. The assembly also includes a one-piece molded safety cap comprising a relatively stiff outer annular base portion and a peripheral skirt portion projecting axially from the base portion for receiving the mouth of the container. A plurality of container locking elements are spaced peripherally from each other on the inner surface of the skirt portion and a plurality of container locking elements are spaced peripherally from each other on the outer surface of the mouth portion such that the cap locking elements are engageable with and disengageable from the container locking elements upon combined axial and rotative motion of the cap relative to the container. A relatively thin, radially outwardly curved sealing portion is joined integrally to the base portion and extends axially therefrom. The cap also includes a relatively stiff, inner disc-like base portion and a resilient annular biasing portion having an inner annular end joined integrally to the inner base portion and which extends axially therefrom. An outer annular end of the biasing portion is joined integrally to the sealing portion. Cap locking elements are located at an equal axial distance from the inner base portion and container locking elements are located an equal axial distance from the rim so that the inner base portion has a fixed axial position relative to the rim when the locking elements are engaged. The biasing portion biases the sealing portion to axially spaced positions such that when the cap is placed on the container the biasing member biases the cap in a fixed axial sealing position relative to the container and simultaneously applies pressure to the sealing portion.

Preferably, the sealing portion includes a wall which curves radially outwardly along substantially the entire length of the sealing portion from the outer annular base portion to the annular biasing portion, the wall providing a "oil-can" effect during axial and rotative motion of the cap relative to the container.

Also, preferably, a rib projects inwardly on the inner surface of the mouth portion of the container adjacent a rim of the mouth portion, the rib comprising an O-ring seal which is continuously engaged by the curved wall during axial and rotative motion of the cap relative to the container.

Preferably, the one-piece cap is molded from polypropylene or polyethylene so that no holes are formed through the top surface of the cap.

The objects, features and advantages of the present invention are readily apparent from the following detailed description of the best mode taken in connection with the accompanying drawings.

BEST MODE FOR CARRYING OUT THE INVENTION

Figure 1:
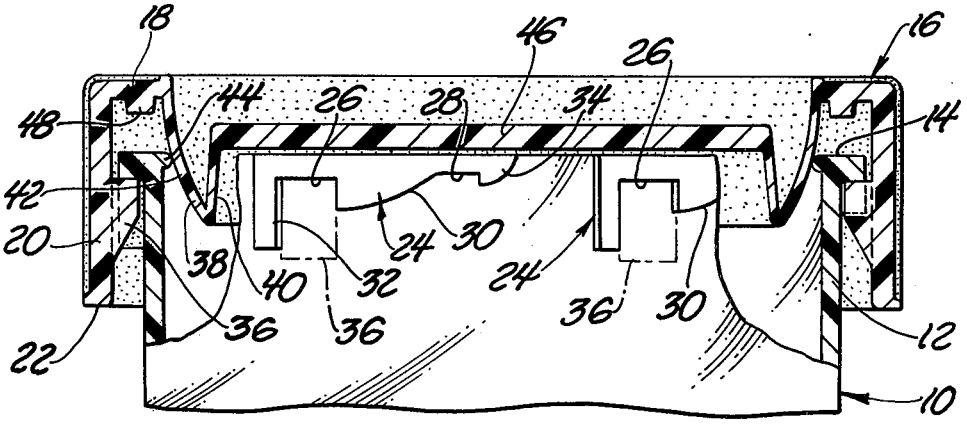
FIG. 1 is a sectional view of a safety closure and container assembly of the present invention, partially broken away, with the cap applied to the container with the container locking elements of the cap shown in phantom in their locked position.

With reference to the drawings, the safety closure and container assembly according to the embodiment of FIGS. 1 through 4 includes a container designated generally by reference numeral 10 and having a neck or mouth portion 12 with an annular rim 14.

The assembly of FIGS. 1 through 4 includes a cap generally indicated at 16, integrally molded from polypropylene or polyethylene.

The cap 16 includes a relatively stiff outer annular base portion 18 with a peripheral skirt portion 20 projecting axially therefrom for receiving the mouth portion 12 of the container 10. In one example, the thickness of the base portion 18 is approximately 0.030 inches. The skirt 20 has a free end 22 opposite the base portion 18.

Formed on the outer surface of the mouth portion 12 of the container 10 is a plurality (six in the illustrated embodiment) of container locking elements generally indicated at 24 of the bayonet type which are spaced peripherally from each other on the outer surface of the mouth portion 12. Each container locking element 24 includes a pair of sockets or first and second notches 26 and 28, respectively. The first notch 26 is formed between a cam surface 30 and a depending stop portion 32. The second notch 28 is formed between the cam surface 30 and a second cam surface 34.

A plurality of cap locking elements 36 in the form of bayonet lugs are spaced peripherally from each other and project from the inner surface of the skirt 20. The cap locking elements 36 are in the form of radially inwardly projecting lugs, integrally molded with the skirt 20 and are bayonet locking mechanisms in the sense that they cooperate in bayonet fashion with the container locking elements 24. The cap locking elements 36 are complementary to the container locking elements 24, such that the cap locking elements are engageable with the second and first notches 28 and 26, respectively, by relative axial motion of the cap 16 toward the container 10 followed successively by rotative motion of the cap 16 relative to the container 10.

Figure 4:
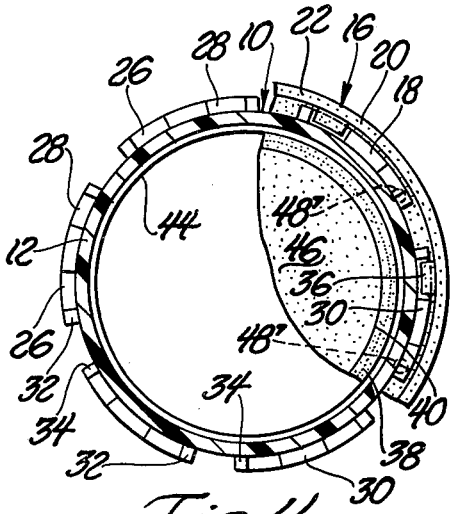
FIG. 4 is a bottom sectional view, partially broken away, of the cap applied to the container.

As shown in FIG. 4, in order to apply the cap 16 to the container 10, the cap locking elements 36 are aligned with the spaces between the adjacent container locking elements 24, with the mouth portion 12 of the container 10 received in the skirt 20. Axial pressure of the cap 16 toward the container 10 coupled with the rotation of the cap 16 relative to the container 10 causes the cap locking elements 36 to first engage the respective second cam surfaces 34 until the cap locking elements 36 come into axial alignment with the respective second notches 28. Further axial pressure of the cap 16 toward the container 10 coupled with rotation of the cap 16 relative to the container 10 causes the cap locking elements 36 to engage the respective first cam surfaces 30 until the cap locking elements come into axial alignment with the respective first notches 26.

With the upper surfaces of the cap locking elements 36 first engaged with the upper surfaces of the second notches 28 and then with the upper surfaces of the first notches 26, the outer annular base portion 18 has two fixed axial positions relative to the rim 14 since the cap locking elements 36 are located at an equal axial distance from the outer annular base portion 18 and the container locking elements 24 are located an equal axial distance from the rim 14. When the cap locking elements are located in the notches 28, less axial pressure is required to discourage the cap locking elements to permit removal of the cap than in the case when the cap locking elements are engaged with the deeper notches 28. Consequently, those adults, such as arthritics, who would have difficulty exerting axial pressure sufficient to engage the cap locking elements on the deeper notches, can use only the notches 28 to lock the cap to the container.

The cap 16 is biased against the axial movement from locked engagement with the container 10 and a liquid and moisture seal is maintained for the contents of the container 10 by a spring-like, sealing portion 38 and a spring-like, annular biasing portion 40, both of which are formed integrally with the outer annular base portion 18. As an example, the sealing poriton 38 has a thickness of 0.015 inches and the biasing portion 40 has a thickness of 0.010 inches. The sealing portion 38 includes an outwardly curved wall 42, the outer surface of which sealingly engages a rib 44 integrally formed with the mouth portion 12 of the container 10 immediately adjacent the rim 14. The rib 44 provides an O-ring effect as it contacts the outer curved wall 42 of the sealing portion 38.

The sealing portion 38 provides extra spring pressure and provides an "oil-can" effect or an over-the-center effect which facilitates movement of the cap locking elements 36 over each of the cam surfaces 34 and 30.

While not shown, the sealing portion 38 may be slightly enlarged at the point of engagement with the rib 44 in the locked position shown in FIG. 1.

Also integrally formed with the annular biasing portion 40 is a disc-like base portion 46 which has a thickness large enough relative to the thickness of the sealing portion 38 and the biasing portion 40 to resist deformation by the spring action of the sealing and biasing portions 38 and 40, respectively. In an example, the thickness of the base portion 46 is approximately 0.035 inches. Preferably, the top surface of the disc-like base portion 46 is axially spaced away from the outer annular base portion 18 towards the free end 22 of the cap 16. However, the disc-like base portion 46 may be axially spaced away from the free end 22 of the cap 15 the same distance as the outer annular base portion 18.

Figure 2:
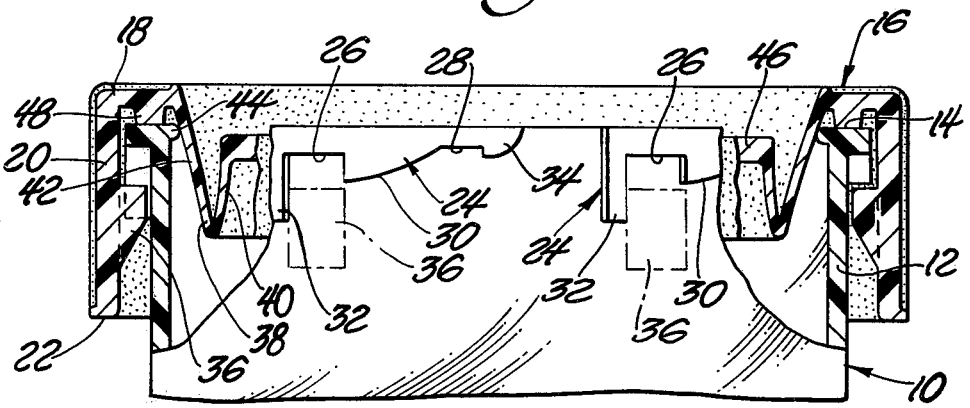
FIG. 2 is a view similar to FIG. 1 showing the cap and container locking elements disengaged from each other upon the application of axial force between the cap and the container.
Figure 3:
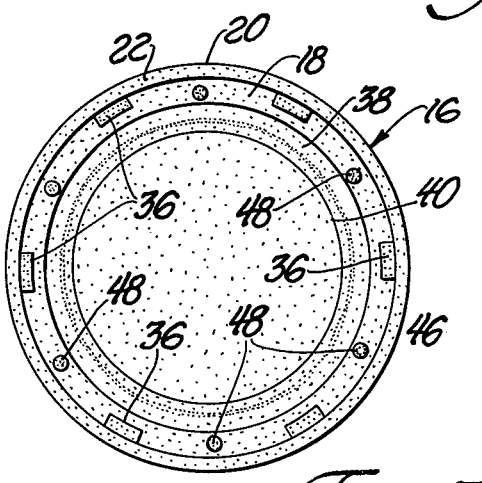
FIG. 3 is a view showing the bottom surface of the integrally molded cap.

The outer annular base portion 18 also includes separate stop lugs 48 integrally formed on the lower surface of the outer annular base portion 18. The lugs 48 are spaced peripherally from each other and project downwardly from the lower surface of the cap 16. However, it is to be understood that instead of the stop lugs 48 a single continuous ring may be provided. The stop lugs 48 limit axial movement of the sealing portion 38 into the mouth of the container 10 by engaging the annular rim 14 of the container 10 as shown in FIG. 2.

In order to remove the cap 16 from the container 10 shown in FIG. 1, it is necessary to first press the cap 16 toward the container 10 against the biasing force of not only the biasing portion 40 but also the sealing portion 38 to disengage the cap locking elements 36 from the first notches 26. Reverse rotation of the cap 16 then permits the cap 16 to be axially withdrawn from the container 10. The "oil-can" effect caused by the sealing portion 38 facilitates removal of the sealing portion 38 from the mouth of the container 10.

While a preferred embodiment of the safety closure and container assembly has been shown and described herein in detail, those skilled in this art will recognize various alternative designs and embodiments for practicing the present invention as defined by the following claims.

What is claimed is:

1. A one-piece molded plastic safety cap of the type adapted to be applied to and removed from a container by axial motion followed successively by rotative motion relative to the container; said cap comprising a relatively stiff, outer annular base portion, a peripheral skirt portion projecting axially from said base portion for receiving the mouth of a container; a plurality of cap locking elements spaced peripherally from each other on the inner surface of said skirt portion for engaging complementary container locking elements on the container; a relatively thin, radially outwardly curved sealing portion joined integrally to said base portion and extending axially therefrom; a relatively stiff, inner disc-like base portion; a resilient, annular biasing portion having an inner, annular end joined integrally to the inner base portion and extending axially therefrom and an outer annular end joined integrally to the sealing portion, the sealing portion extending axially in the opposite direction therefrom; said biasing portion biasing said sealing portion to axially spaced positions, such that when the cap is placed on a container, the biasing portion biases the cap in a fixed axial sealing position relative to the container and simultaneously applies pressure to the sealing portion.

2. The cap as claimed in claim 1 wherein said container locking elements are adapted to engage said cap locking elements in bayonet fashion.

3. The cap as claimed in claim 1 including at least one stop member extending axially from said outer base portion such that when the cap is placed on the container said stop member prevents overstressing of the biasing portion upon engagement of a mouth portion of the container.

4. The cap as claimed in claim 1 or claim 2 or claim 3 wherein said sealing portion is adapted to be continuously engaged by a rib projecting inwardly on the inner surface of a mouth portion of a container adjacent a rim of the mouth portion during axial and rotative motion of the cap relative to the container.

5. The cap as claimed in claim 4 wherein the rib comprises an O-ring seal.

6. A safety container and closure assembly comprising: a container having a mouth portion with an annular rim, a one-piece molded plastic safety cap comprising a relatively stiff, outer annular base portion, a peripheral skirt portion projecting axially from said base portion for receiving the mouth of the container; a plurality of cap locking elements spaced peripherally from each other on the inner surface of said skirt portion; a plurality of container locking elements spaced peripherally from each other on the outer surface of said mouth portion; said cap locking elements being engageable with and disengageable from said container locking element by combined axial and rotative motion of the cap relative to the container; a relatively thin, radially outwardly curved sealing portion joined integrally to said base portion and extending axially therefrom; a relatively stiff, inner disc-like base portion, said cap locking elements being located an equal axial distance from said inner base portion and said container locking elements being located an equal axial distance from said rim whereby said inner base portion has a fixed axial position relative to said rim when said locking elements are engaged; a resilient, annular biasing portion having an inner annular end joined integrally to the inner base portion and extending axially therefrom and an outer annular end joined integrally to the sealing portion, the sealing portion extending axially in the opposite direction therefrom; said biasing portion biasing said sealing portion to axially spaced positions such that when the cap is placed on the container the biasing member biases the cap in a fixed axial sealing position relative to said container and simultaneously applies pressure to the sealing portion.

7. The assembly as claimed in claim 6 wherein said container further includes a rib projecting radially inwardly on the inner surface of the container adjacent the rim for sealing engagement with said sealing portion in said fixed axial sealing position.

8. The assembly as claimed in claim 6 wherein said container further includes a rib projecting radially inwardly on the inner surface of the container immediately adjacent the rim for sealing engagement with said sealing portion in said fixed axial position.

9. The assembly as claimed in claim 7 or claim 8 wherein said rib slidably engages said sealing portion during axial and rotative motion of the cap relative to the container.

10. The assembly as claimed in claim 7 or claim 8 wherein said rib continuously engages said sealing portion during axial and rotative motion of the cap relative to the container.

11. The assembly as claimed in claim 7 or claim 8 wherein said sealing portion includes a radially outwardly curved wall and wherein said rib continuously engages said wall during axial and rotative motion of the cap relative to the container.

12. The assembly as claimed in claim 11 wherein said wall curves outwardly along substantially its entire length from said outer annular base portion to said annular biasing portion and wherein said wall provides an oil-can effect during axial and rotative motion of the cap relative to the container.

* * * * *